US008571444B2

(12) United States Patent
Oda et al.

(10) Patent No.: US 8,571,444 B2
(45) Date of Patent: Oct. 29, 2013

(54) NEUTRALIZATION DEVICE, DEVELOPING DEVICE AND IMAGE FORMING APPARATUS

(75) Inventors: Yukiyoshi Oda, Tokyo (JP); Akihiro Yamamura, Tokyo (JP); Masahiro Kawano, Tokyo (JP); Ken Nozawa, Tokyo (JP); Toshiharu Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 433 days.

(21) Appl. No.: 12/926,452

(22) Filed: Nov. 18, 2010

(65) Prior Publication Data

US 2011/0129254 A1 Jun. 2, 2011

(30) Foreign Application Priority Data

Nov. 26, 2009 (JP) ..... 2009-268204

(51) Int. Cl.
*G03G 21/00* (2006.01)

(52) U.S. Cl.
USPC ..... 399/128

(58) Field of Classification Search
USPC ..... 399/128–129, 186; 385/129
See application file for complete search history.

(56) References Cited

U.S. PATENT DOCUMENTS

2005/0265684 A1 * 12/2005 Nemoto et al. ..... 385/146

FOREIGN PATENT DOCUMENTS

| | | | | |
|---|---|---|---|---|
| JP | 04-65372 | | | 6/1992 |
| JP | 08-043633 | A | | 2/1996 |
| JP | 08-240963 | A | | 9/1996 |
| JP | 09171111 | A | * | 6/1997 |
| JP | 2003-295717 | A | | 10/2003 |
| JP | 2004-351649 | A | | 12/2004 |
| JP | 2006-078798 | A | | 3/2006 |
| JP | 2008-083185 | A | | 4/2008 |
| WO | WO-2006-120932 | A1 | | 11/2006 |

* cited by examiner

*Primary Examiner* — David Gray
*Assistant Examiner* — Andrew Do
(74) *Attorney, Agent, or Firm* — Rabin & Berdo, P.C.

(57) ABSTRACT

A neutralization device includes a light emitter, an optical conductor and multiple diffusion portions. The light emitter emits light for neutralizing an object. The optical conductor, which is opposed to the object and extends in a longitudinal direction, directs and applies the light to the object. The diffusion portions are arranged on the optical conductor in a zig-zag manner from one end of the optical conductor to the other and diffuse the light.

17 Claims, 18 Drawing Sheets

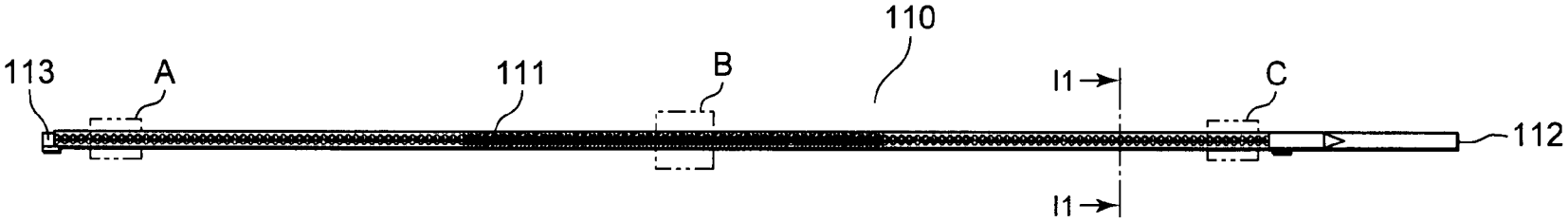
FIG. 6A
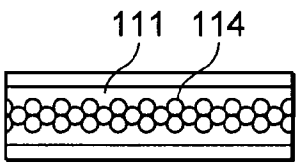
FIG. 6B
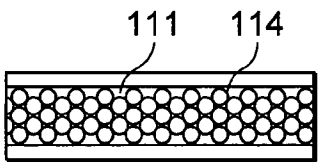
FIG. 6C
FIG. 6D
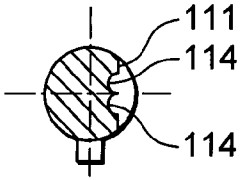
FIG. 6E

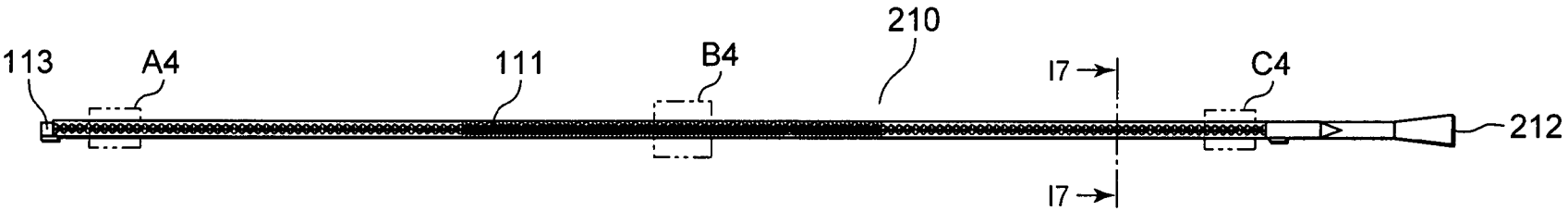
FIG. 15A
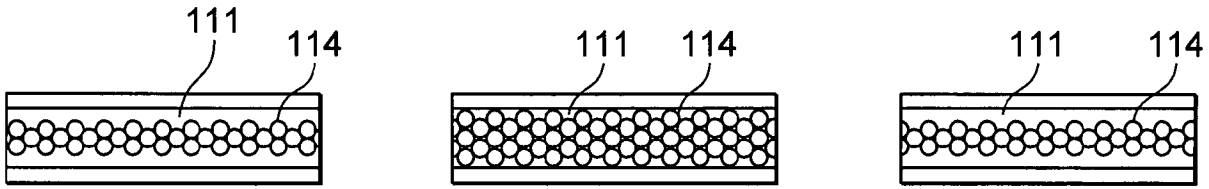
FIG. 15B
FIG. 15C
FIG. 15D
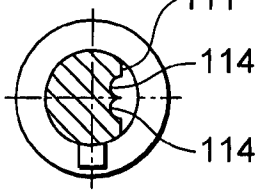
FIG. 15E

NEUTRALIZATION DEVICE, DEVELOPING DEVICE AND IMAGE FORMING APPARATUS

CROSS-REFERENCE TO RELATED APPLICATION

This application claims priority under 35 USC 119 of prior Japanese Patent Application No. P 2009-268204 filed on Nov. 26, 2009, the entire contents of which are incorporated herein by reference.

BACKGROUND OF THE INVENTION

1. Field of the Invention

This application relates to a neutralization device and a developing device that includes the neutralization device. This application also relates to an image forming apparatus that includes the developing device.

2. Description of the Related Art

An image forming apparatus employing electrophotographic technology, such as a printer, a copier or a facsimile machine, includes a photosensitive drum, a charging roller, an exposure head, a developing roller, a transfer roller and a fixing unit. The charging roller uniformly charges a surface of the drum. The exposure head exposes the charged surface of the drum to light to form an electrostatic latent image. The developing roller develops the latent image with toner, thereby forming a toner image on the drum. The transfer roller transfers the toner image to a sheet. The fixing unit fixes the toner image onto the sheet.

The image forming apparatus also includes a neutralization device, which neutralizes the charged surface of the drum after the toner image has been transferred to the sheet. The device is composed of a columnar optical conductor, which has an optical diffusion region on its side extending in the longitudinal direction. The conductor receives light emitted by a light source and applies the light to the surface of the drum through the diffusion region to neutralize the surface. Japanese Patent Laid-Open No. 8-43633 discloses one such neutralization device.

In the aforementioned neutralization device, however, the light applied to the drum by the conductor lacks uniformity, resulting in nonuniform neutralization of the surface of the drum.

SUMMARY OF THE INVENTION

An object of the application is to disclose a neutralization device, a developing device and an image forming apparatus, capable of neutralizing a surface of an object uniformly.

According to one aspect, a neutralization device includes a light emitter, an optical conductor and multiple diffusion portions. The light emitter emits light for neutralizing an object. The optical conductor, which is opposed to the object and extends in a longitudinal direction, directs and applies the light to the object. The diffusion portions are arranged on the optical conductor in a zig-zag manner from one end of the optical conductor to the other, and diffuse the light.

According to another aspect, a neutralization device includes a light emitter, an optical conductor and multiple diffusion portions. The light emitter emits light for neutralizing an object. The optical conductor, which is opposed to the object and extends in a longitudinal direction, directs and applies the light to the object. The diffusion portions are arranged on the optical conductor on multiple parallel lines that extend in the longitudinal direction of the optical conductor and diffuse the light. The lines include a first line and a second line adjacent to the first. The diffusion portions include multiple first diffusion portions arranged on the first line and multiple second diffusion portions arranged on the second line. Each first diffusion portion is adjacent to at least one of the second diffusion portions, and each first diffusion portion has a center point that is separated in the longitudinal direction from a center point of each second diffusion portion that is adjacent to the first.

According to yet another aspect, a developing device includes an image bearing body, a charging member, a light emitter, an optical conductor and multiple diffusion portions. The charging member, which is in contact with the image bearing body, charges a surface of the image bearing body. The light emitter emits light for neutralizing the image bearing body. The optical conductor, which is opposed to the image bearing body and extends in a longitudinal direction, directs and applies the light to the object. The diffusion portions are arranged on the optical conductor in a zig-zag manner from one end of the optical conductor to the other, and diffuse the light.

In a further aspect, an image forming apparatus includes the developing device, a transfer unit and a fixing unit. The developing device forms an image. The transfer unit transfers the image to a medium. The fixing unit fixes the image onto the medium.

The full scope of applicability of the neutralization device, the developing device and the image forming apparatus will become apparent to those skilled in the art from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The neutralization device, the developing device and the image forming apparatus will become more fully understood from the following detailed description with reference to the accompanying drawings, which are given by way of illustration only, and thus not to limit the invention, and wherein:

FIG. 6A is a side view of an optical conductor of the first embodiment;

FIG. 6B is an enlarged side view of the optical conductor in an area A of FIG. 6A;

FIG. 6C is an enlarged side view of the optical conductor in an area B of FIG. 6A;

FIG. 6D is an enlarged side view of the optical conductor in an area C of FIG. 6A;

FIG. 6E is an enlarged cross-sectional view of the optical conductor along a line I1-I1 of FIG. 6A;

FIG. 15A is a side view of an optical conductor of a second embodiment;

FIG. 15B is an enlarged side view of the optical conductor in an area A4 of FIG. 15A;

FIG. 15C is an enlarged side view of the optical conductor in an area B4 of FIG. 15A;

FIG. 15D is an enlarged side view of the optical conductor in an area C4 of FIG. 15A;

FIG. 15E is an enlarged cross-sectional view of the optical conductor along a line I7-I7 of FIG. 15A;

DETAILED DESCRIPTION OF THE INVENTION

Preferred embodiments of a neutralization device, a developing device and an image forming apparatus according to the invention will be described in detail with reference to the accompanying drawings. In each embodiment, the description will be given with an electrophotographic color printer as an image forming apparatus.

First Embodiment

Figure 1:
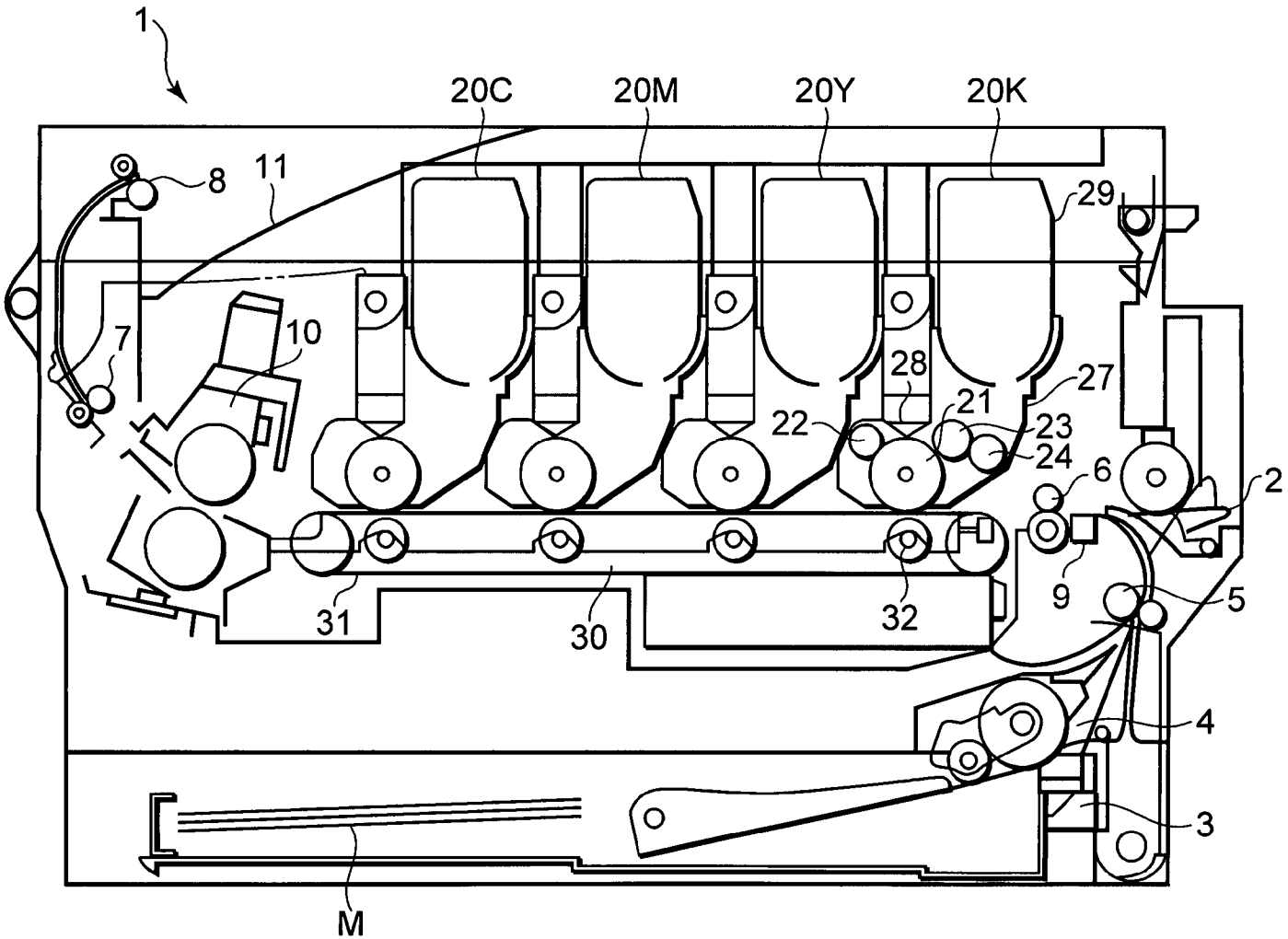
FIG. 1 is a schematic view of a printer of a first embodiment.

FIG. 1 is a schematic view of a printer 1 of a first embodiment, which may include a sheet path 2, a sheet cassette 3, a sheet feeder 4, transport rollers 5, 6, 7 and 8, a sheet thickness sensor 9, image-forming units 20K, 20Y, 20M and 20C, a transfer unit 30, a fixing unit 10 and a stacker 11.

The sheet path 2 is substantially S-shaped. The sheet cassette 3 and the stacker 11 are respectively provided at one end and the other end of the path. The cassette accommodates a stack of sheets M as media. The sheet feeder 4 feeds the sheet from the cassette into the path. The transport rollers 5, 6, 7 and 8, which are disposed along the path, transport the sheet. The sheet thickness sensor 9 detects the thickness of the sheet. The image-forming units 20K, 20Y, 20M and 20C as developing devices respectively form a black toner image, a yellow toner image, a magenta toner image and a cyan toner image. The transfer unit 30 includes a transfer belt 31, which transports the sheet while electrostatically adhering it. The transfer unit opposes the image-forming units and transfers the toner images formed by the image-forming units to the sheet on the transfer belt. The fixing unit 10 fixes the toner images onto the sheet. The stacker 11 holds the sheet on which the toner images are fixed.

Next, the image-forming units 20K, 20Y, 20M and 20C will be described in detail. Because the image-forming units have the same structure, except for toner colors, the image-forming unit 20K, forming a black toner image, will be described by way of example here.

Figure 2:
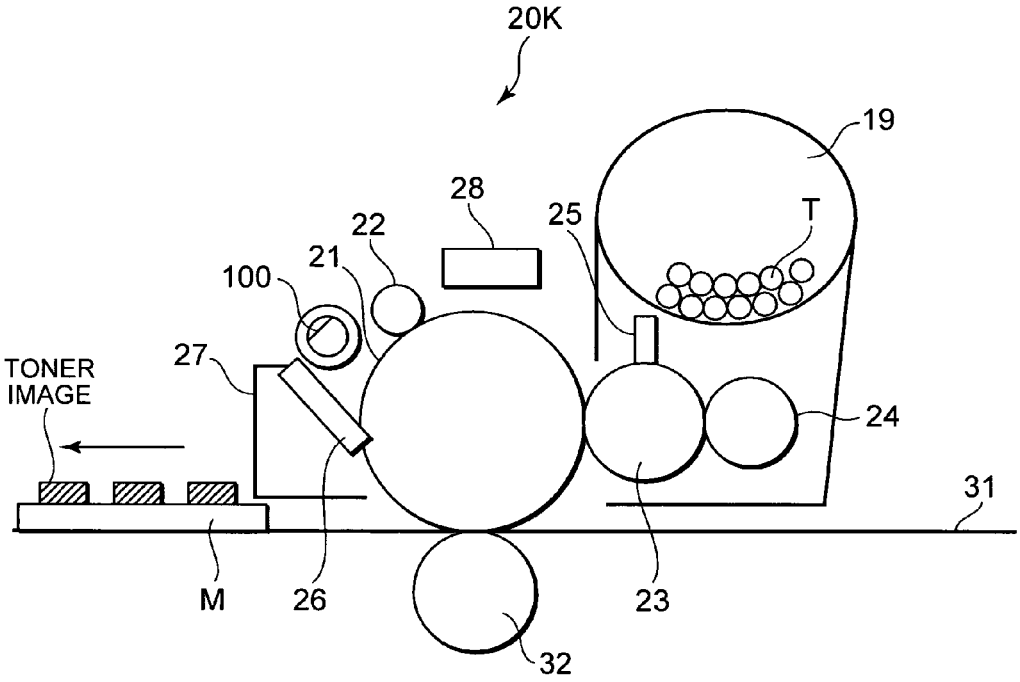
FIG. 2 is a schematic view of an image-forming unit of the first embodiment.

FIG. 2 is a schematic view of the image-forming unit 20K, which may incorporate a photosensitive drum 21, a charging roller 22, a developing roller 23, a toner supply roller 24, a developing blade 25, an elastic cleaning blade 26 and a neutralization unit 100 in a chassis 27.

The photosensitive drum 21, as an object to be neutralized and being a cylindrical image bearing body, is rotatable at a predetermined speed. The drum is also capable of storing electric charge on its surface. The charging roller 22, serving as a charging member, is pressed toward the drum and uniformly charges the surface of the drum by applying a predetermined voltage thereto. The charged surface of the drum is exposed to light emitted by an exposure head 28, which incorporates multiple LEDs (Light-Emitting Diodes), to form an electrostatic latent image. The developing roller 23 is pressed toward the drum and develops the latent image with toner T, thereby forming a toner image on the drum surface.

The toner supply roller 24 is pressed toward the developing roller 23, and supplies the toner T from a toner cartridge 29 detachably mounted on the chassis 27, to the developing roller. The developing blade 25 forms a layer of toner of uniform thickness on the developing roller. After the toner image has been transferred to the sheet M, the cleaning blade 26, which is pressed toward the photosensitive drum 21, scrapes any remaining toner off the drum. The neutralization unit 100 then applies light to the surface of the drum to remove the electric charge from the surface.

In addition, a transfer roller 32 is provided under the photosensitive drum 21 and opposes the drum through the transfer belt 31. The transfer roller receives a voltage from a power supply, not shown, and transfers the toner image on the drum to the sheet M.

Figure 3:
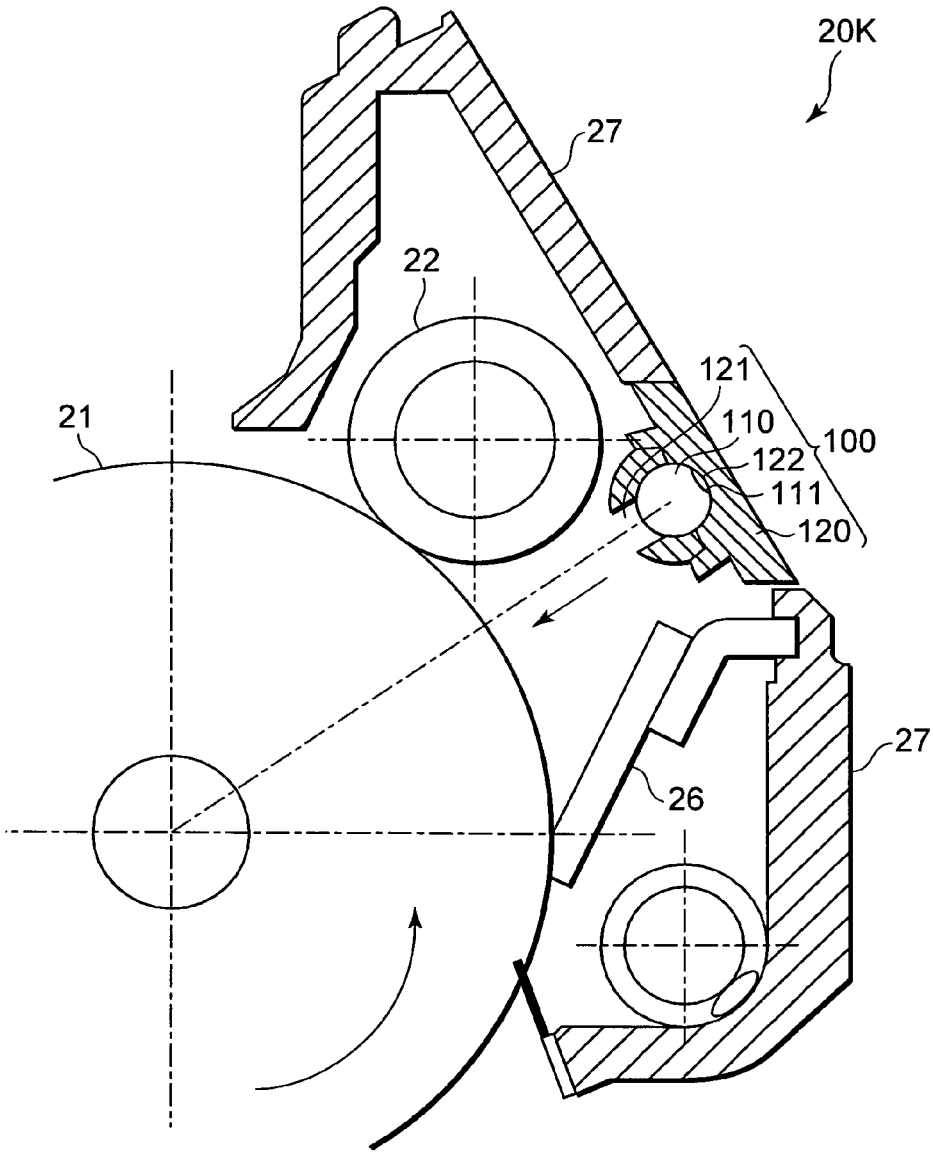
FIG. 3 is a partial cross-sectional view of the image-forming unit including a neutralization unit of the first embodiment.
Figure 4:
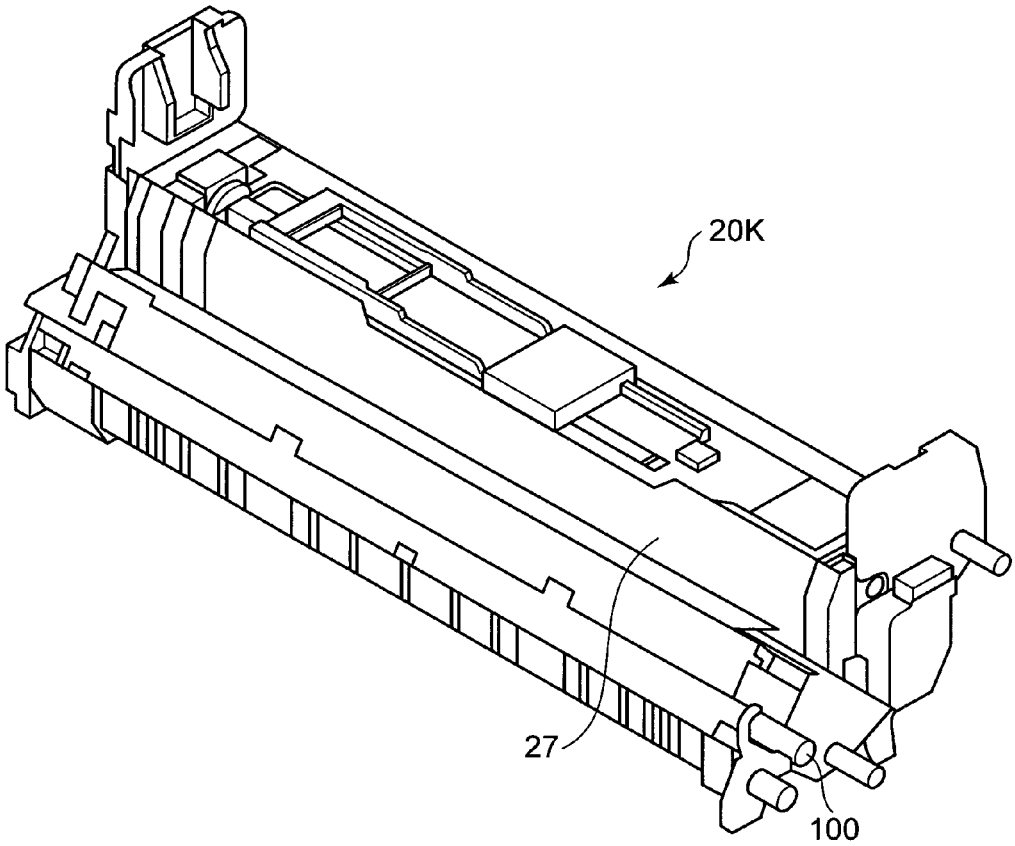
FIG. 4 is a first perspective view of the image-forming unit of the first embodiment.
Figure 5:
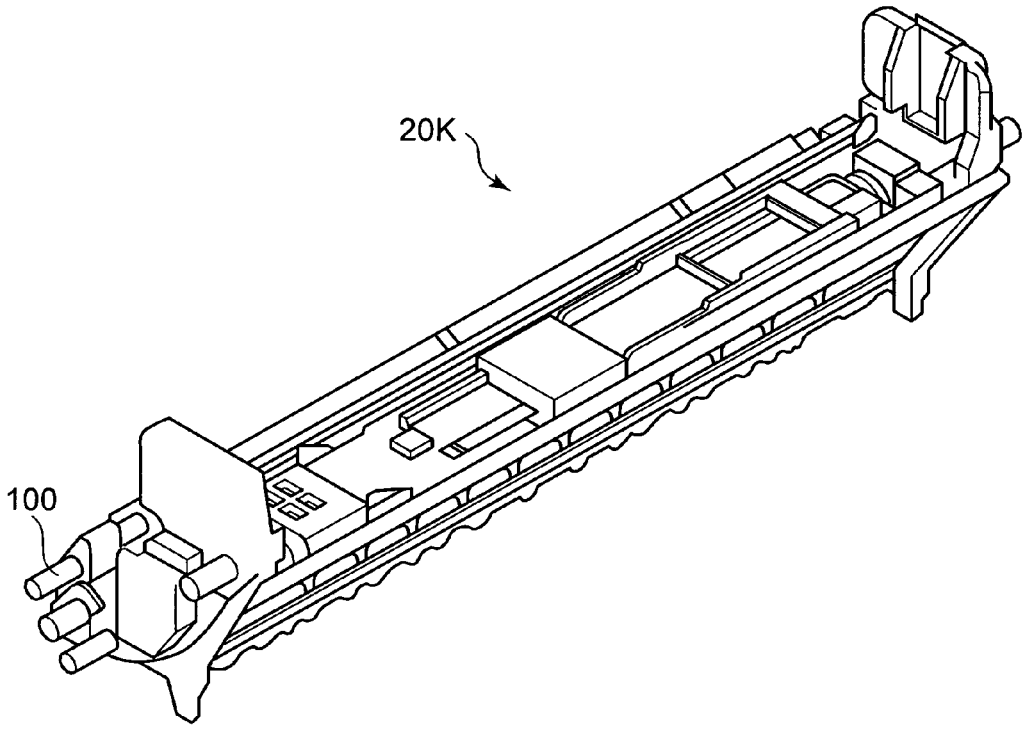
FIG. 5 is a second perspective view of the image-forming unit of the first embodiment.

Next, the neutralization unit 100 will be described in detail. FIG. 3 is a partial cross-sectional view of the image-forming unit 20K including the neutralization unit 100. FIGS. 4 and 5 are respectively first and second perspective views of the image-forming unit.

As shown in FIGS. 3, 4 and 5, the neutralization unit 100 is provided to extend parallel to the longitudinal direction of the photosensitive drum 21. The neutralization unit 100 includes a columnar optical conductor 110 with a cover 120. The conductor 110 has an optical diffusion region 111 on a side that is opposite to a side that faces the drum. The conductor 110 may be made of a transparent material such as polymethylmethacrylate (PMMA) resin. The cover has an opening 121 on a side that faces the drum. An inside wall 122 of the cover surrounds the conductor 110.

Figure 7A:
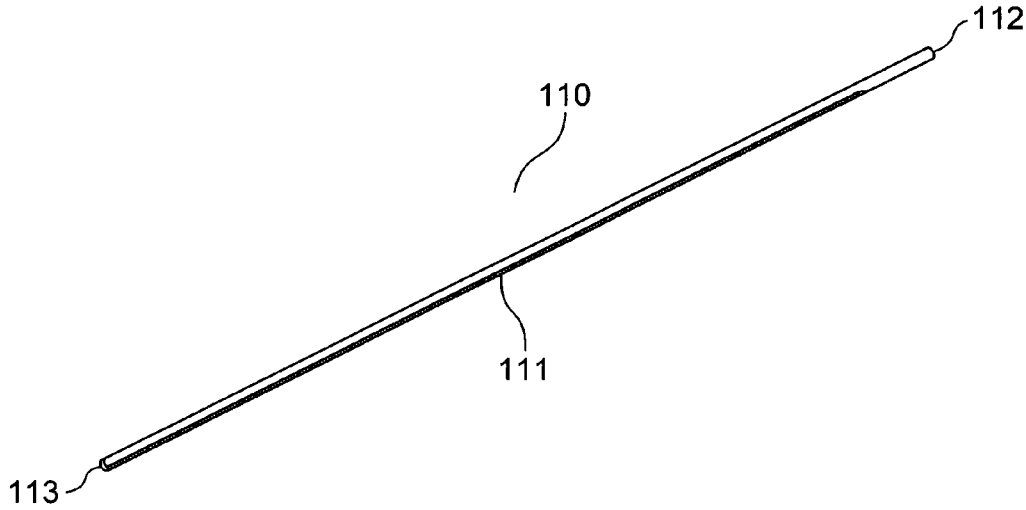
FIG. 7A is a first perspective view of the optical conductor of the first embodiment.
Figure 7B:
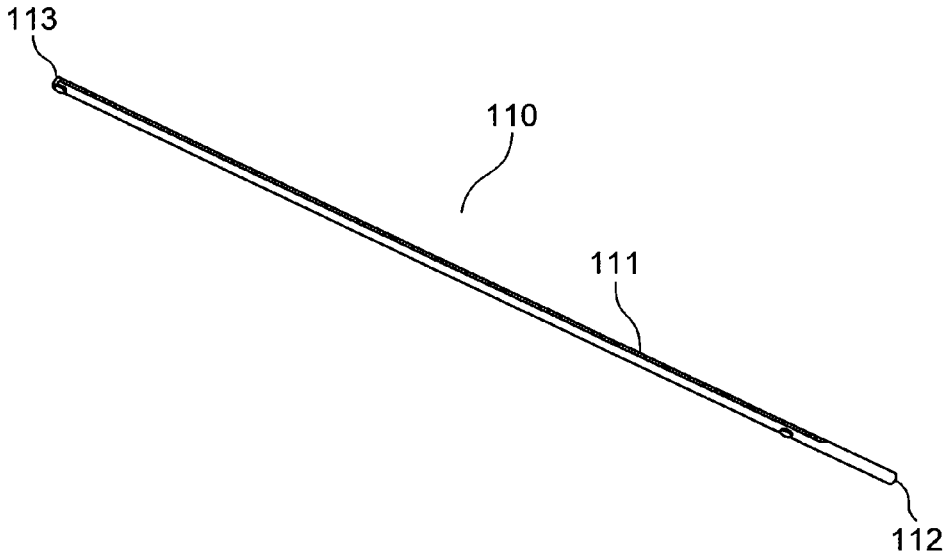
FIG. 7B is a second perspective view of the optical conductor of the first embodiment.

Next, the conductor 110 will be described in detail. FIG. 6A is a side view of the conductor 110. FIGS. 6B, 6C and 6D are enlarged side views of the conductor 110 respectively in areas A, B and C of FIG. 6A. FIG. 6E is an enlarged cross-sectional view of the conductor 110 along a line I1-I1 of FIG. 6A. FIGS. 7A and 7B are respectively first and second perspective views of the conductor 110.

As shown in FIGS. 6A, 7A and 7B, the conductor 110 includes the diffusion region 111, a first end face 112 that receives light, and a second end face 113 that is opposite to the end face 112. The diffusion region 111 has multiple circular concave portions 114 as diffuser portions that diffuse light. The concave portions are substantially the same in shape and size, and are arranged on the conductor 110 on multiple parallel lines that extend in the longitudinal direction. As shown in FIGS. 6B, 6C and 6D, the number of lines in the area B (FIG. 6C), i.e., in the vicinity of a central area of the conductor 110, is larger than the numbers of lines in the areas C (FIG. 6D) and A (FIG. 6B), i.e., in the vicinity of the end faces 112 and 113 of the conductor 110.

In addition, the concave portions 114 are arranged on the conductor 110 in a zig-zag manner from one end of the conductor 110 to the other in the longitudinal direction. Specifically, as shown in FIG. 6B, assuming that multiple first concave portions are arranged on a first line L1 that extends in the longitudinal direction of the conductor 110 and multiple second concave portions are arranged on a second line L2 that is parallel to and adjacent to the line L1, each first concave portion is adjacent to or in contact with at least one of the second diffusion portions, and each first diffusion portion has a center point that is separated in the longitudinal direction from a center point of each second diffusion portion that is adjacent thereto or in contact therewith.

In the first embodiment, as shown in FIGS. 6B and 6D, the numbers of lines in the areas A and C are both three. In addition, as described above, the concave portions 114 are arranged on the conductor 110 in a zig-zag manner relative to the longitudinal direction in the areas A and C. On the other hand, as shown in FIG. 6C, the number of lines in the area B is five. In addition, similarly to the areas A and C, the concave portions are arranged on the conductor 110 in a zig-zag manner relative to the longitudinal in the area B.

It should be noted that the numbers of lines in the respective areas A and C are not limited to three as long as the concave portions 114 are arranged on the conductor 110 in a zig-zag manner relative to the longitudinal direction. The number of lines in each of the areas A and C may be two or more. Similarly, it should be noted that the number of lines in the area B is not limited to five as long as the concave portions are arranged on the conductor 110 in a zig-zag manner relative to the longitudinal direction. The number of lines in the area B may be three or more.

Figure 8B:
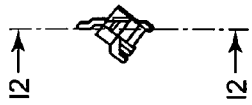
FIG. 8B is an end view of the neutralization unit from the direction of arrow F1 of FIG. 8A.
Figure 8D:
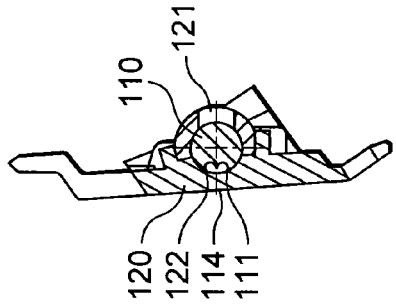
FIG. 8D is an enlarged cross-sectional view of the neutralization unit along a line I3-I3 of FIG. 8A.
Figure 8A:
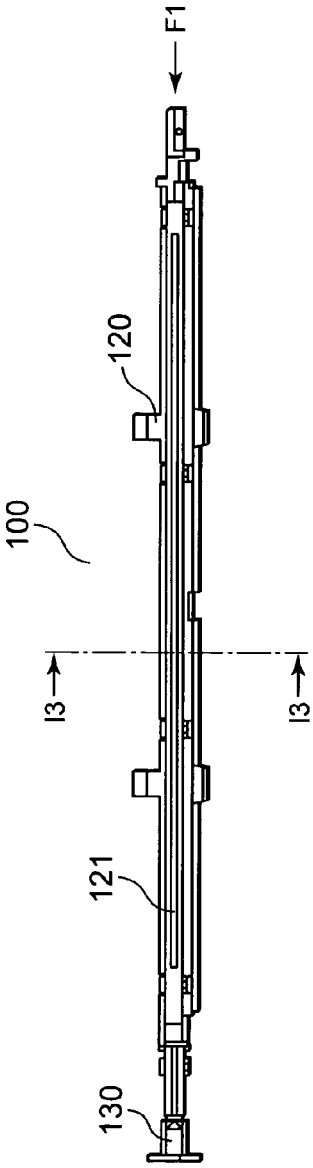
FIG. 8A is a side view of the neutralization unit of the first embodiment.
Figure 8C:
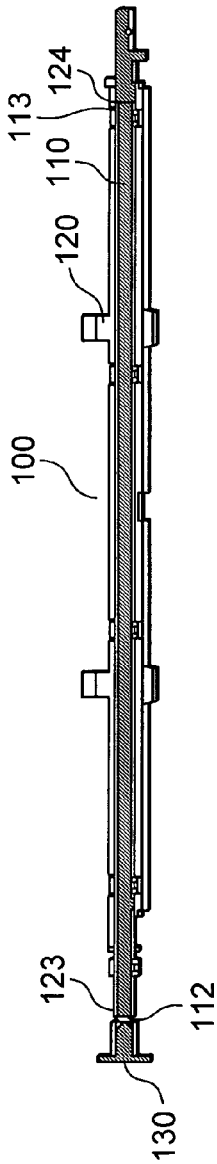
FIG. 8C is a cross-sectional view of the neutralization unit along a line I2-I2 of FIG. 8B.
Figure 9:
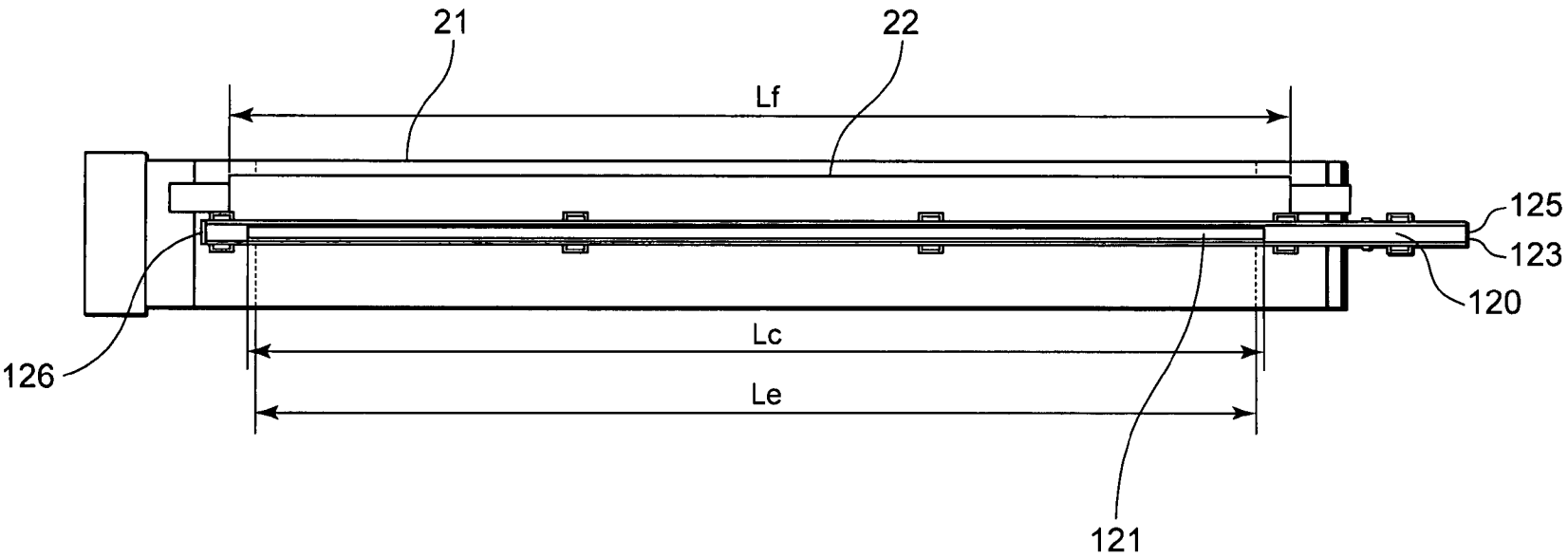
FIG. 9 is a side view of a cover for the optical conductor of the first embodiment.
Figure 10A:
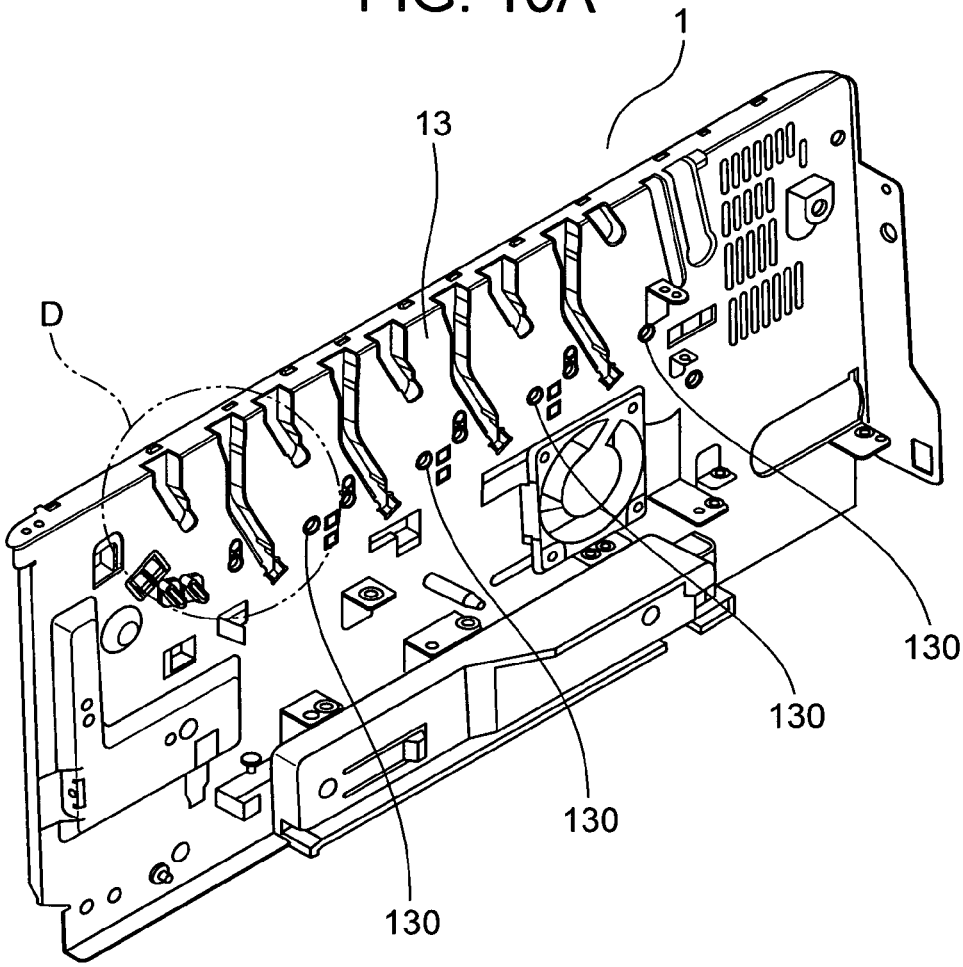
FIG. 10A is a perspective view of a side wall of the printer of the first embodiment.
Figure 10B:
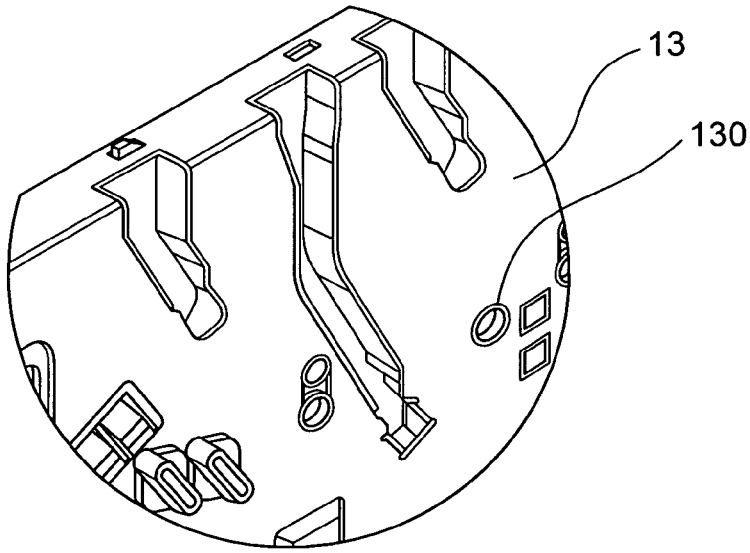
FIG. 10B is an enlarged perspective view of the side wall in an area D of FIG. 10A.

Next, the neutralization unit 100 will be described in more detail. FIG. 8A is a side view of the neutralization unit 100. FIG. 8B is an end view of the neutralization unit 100 from the direction of arrow F1 of FIG. 8A. FIG. 8C is a cross-sectional view of the neutralization unit 100 along a line I2-I2 of FIG. 8B. FIG. 8D is an enlarged cross-sectional view of the neutralization unit 100 along a line I3-I3 of FIG. 8A. FIG. 9 is a side view of the cover 120 for the conductor 110. FIG. 10A is a perspective view of a side wall 13 of the printer 1. FIG. 10B is an enlarged perspective view of the side wall in an area D of FIG. 10A.

As shown in FIG. 8C, the cover 120 has an opening 123 at one end, which corresponds to the end face 112 of the conductor 110, so that the conductor 110 can receive light emitted by a light source 130 described later. The cover 120 also has a reflective surface 124, which corresponds to the opposite end face 113.

As shown in FIG. 9, a length Lc of an exposure area of the conductor 110, i.e., the length of the opening 121 of the cover 120 measured in its longitudinal direction is smaller than a length Lf of a charging area, i.e., the length of the charging roller 22. This can prevent light applied to the photosensitive drum 21 by the conductor 110 from escaping downstream of the charging roller in the rotational direction of the drum (FIG. 3) and interfering with the formation of the electrostatic latent image. In addition, the length Lc is larger than a length Le of a printable area of the drum. Therefore, the neutralization unit 100 can reliably neutralize the printable area. The opening 123 is formed at a first end 125 of the cover. On the other hand, an opposite second end 126 is closed. The entire cover or the inside wall 122 (FIG. 3) of the cover is white or silver in color.

As shown in FIGS. 10A and 10B, the light sources 130 as light emitters are mounted on an inner surface of the side wall 13. Each of the light sources may be an LED element, a laser element or the like.

Next, a printing operation of the printer 1 will be described with reference to FIGS. 1 and 2. When the printing operation is initiated, the sheet feeder 4 feeds the sheet M from the sheet cassette 3 into the sheet path 2. The transport rollers 5 and 6 transport the sheet to the transfer unit 30. The sheet thickness sensor 9 detects the thickness of the sheet transported by the transport rollers 5 and 6.

Meanwhile, in the image-forming unit 20K, the charging roller 22 uniformly charges a surface of the photosensitive drum 21. The exposure head 28 exposes the charged surface of the drum to light to form an electrostatic latent image. The toner supply roller 24 supplies the toner T from the toner cartridge 29 to the developing roller 23. The developing blade 25 forms a layer of toner of uniform thickness on the developing roller. The developing roller develops the latent image with the toner, thereby forming a black toner image on the surface of the drum. The transfer roller 32 transfers the formed black toner image to the sheet M. After the black toner image has been transferred to the sheet, the cleaning blade 26 scrapes any remaining toner off the drum. The scraped off toner is conveyed to a waste toner container by a spiral conveyer, not shown.

Similarly to the image-forming unit 20K, the image-forming units 20Y, 20M and 20C respectively form a yellow toner image, a magenta toner image and a cyan toner image. The transfer unit 30 transfers these toner images to the sheet M on the transfer belt 31 in series. The fixing unit 10 then fixes the transferred toner images onto the sheet. The transport rollers 7 and 8 transport the toner image-bearing sheet to the stacker 11.

Next, a neutralizing operation of the neutralization unit 100 will be described. After the cleaning blade 26 has scraped the toner off the photosensitive drum 21, the neutralization unit 100 neutralizes the surface of the drum to make the surface of the drum electrically uniform.

Referring to FIG. 8C, the conductor 110 receives light emitted by the light source 130 through the opening 123 of the cover 120. Referring to FIG. 8D, the received light is diffused by the concave portions 114 of the diffusion region 111 and is repeatedly reflected by the inside wall 122 of the cover. Then, the light comes out from the opening 121 of the cover toward the photosensitive drum 21.

Meanwhile, light that has not been diffused by the concave portions 114 travels in the conductor 110 and is reflected by the reflective surface 124 of the cover 120. The reflected light is diffused by the concave portions and is repeatedly reflected by the inside wall 122. Then, the light comes out from the opening 121 of the cover toward the photosensitive drum 21.

The intensity of light received from the light source 130 is high in the vicinity of the end face 112 of the conductor 110. However, the light intensity in the vicinity of the central area of the conductor 110 becomes lower than that in the vicinity of the end face 112 because the light is used for neutralization of the photosensitive drum 21. Meanwhile, the light intensity in the vicinity of the opposite end face 113 becomes higher than that in the vicinity of the central area, because the light that travels in the conductor 110 is reflected by the reflective surface 124. Therefore, in the first embodiment, the number of lines in the area B (FIG. 6C) is larger than the numbers of lines in the areas C (FIG. 6D) and A (FIG. 6B), thereby increasing the amount of diffusion of light in the area B and making the light intensity in the longitudinal direction of the conductor 110 uniform.

In addition, as described above, the concave portions 114 are arranged on the conductor 110 in a zig-zag manner relative to the longitudinal direction. Therefore, the longitudinally extending neutralization unit 100 can uniformly expose and neutralize the surface of the photosensitive drum 21.

Figure 11A:
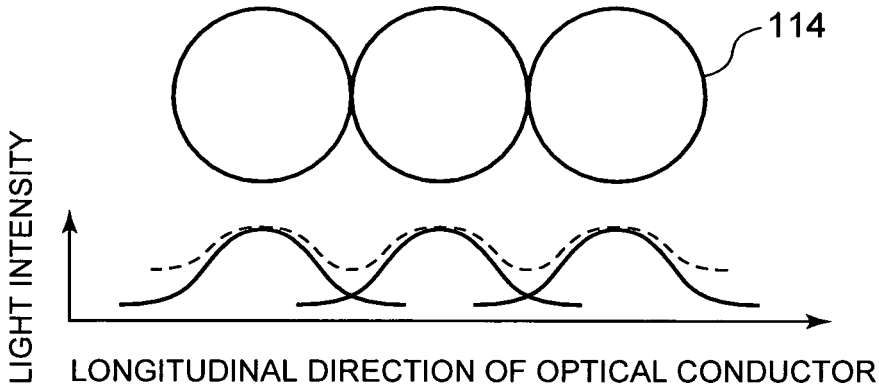
FIG. 11A is a chart of the distribution of the light intensity when concave portions are arranged on the optical conductor of the first embodiment in a line relative to the longitudinal direction.
Figure 11B:
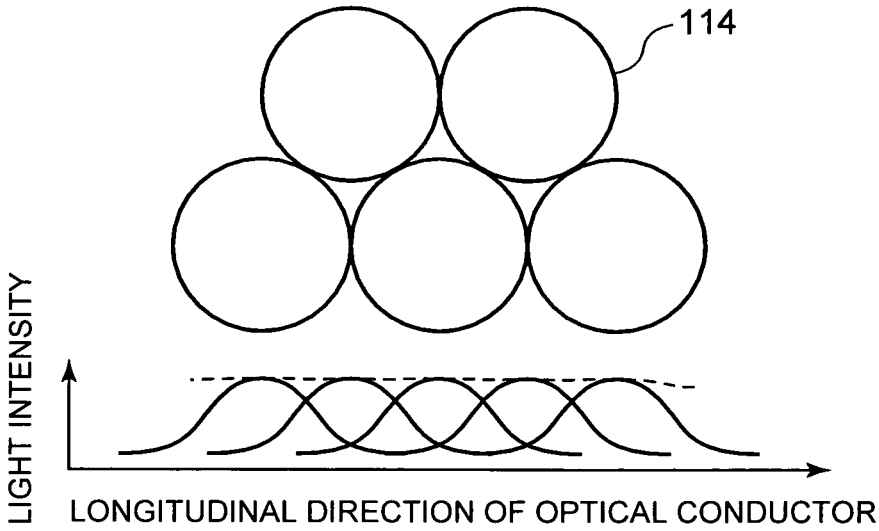
FIG. 11B is a chart of the distribution of the light intensity when concave portions are arranged on the optical conductor of the first embodiment in a zig-zag manner relative to the longitudinal direction.

FIG. 11A is a chart of the distribution of the light intensity when the concave portions 114 are arranged on conductor 110 in a line relative to the longitudinal direction. FIG. 11B is a chart of the distribution of the light intensity when the concave portions 114 are arranged on conductor 110 in a zig-zag manner relative to the longitudinal direction. In FIGS. 11A and 11B, solid lines and broken lines respectively denote the intensity of light diffused by each of the concave portions 114 and the combined light intensity.

As shown in FIG. 11A, when the concave portions 114 are arranged on the conductor 110 in a line, the combined light intensity varies significantly. On the other hand, when the concave portions 114 are aligned on the conductor 110 in a zig-zag manner, the combined light is uniform.

As described above, in the first embodiment, the concave portions 114 of the diffusion region 111 are arranged on the conductor 110 in a zig-zag manner from one end of the conductor 110 to the other in the longitudinal direction. Therefore, the neutralization unit 100 can uniformly expose and neutralize the surface of the photosensitive drum 21. In addition, the length Lc of the exposure area of the conductor 110 is smaller than the length Lf of the charging area of the charging roller 22. Therefore, the neutralization unit 100 can prevent light applied to drum by the conductor 110 from escaping downstream of the charging roller in the rotational direction of the drum and interfering with the formation of the electrostatic latent image. Moreover, the length Lc is larger than the length Le of the printable area of the drum. Therefore, the neutralization unit 100 can reliably neutralize the printable area. Furthermore, the concave portions are circular in shape. Therefore, the conductor 110 can be molded with high accuracy.

First Modification

Figure 12A:
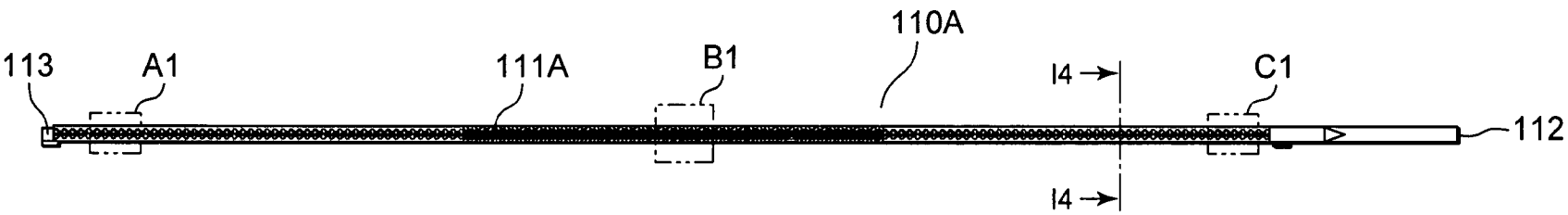
FIG. 12A is a side view of an optical conductor of a first modification.
Figure 12B:
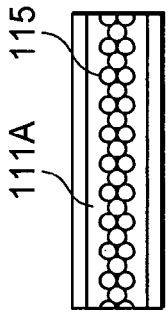
FIG. 12B is an enlarged side view of the optical conductor in an area A1 of FIG. 12A.
Figure 12C:
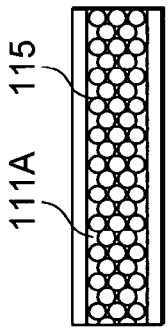
FIG. 12C is an enlarged side view of the optical conductor in an area B1 of FIG. 12A.
Figure 12D:
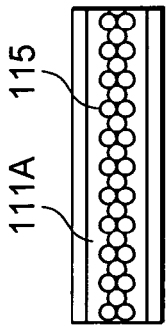
FIG. 12D is an enlarged side view of the optical conductor in an area C1 of FIG. 12A.
Figure 12E:
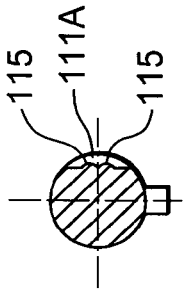
FIG. 12E is an enlarged cross-sectional view of the optical conductor along a line I4-I4 of FIG. 12A.

FIG. 12A is a side view of an optical conductor 110A of a first modification. FIGS. 12B, 12C and 12D are enlarged side views of the conductor 110A respectively in areas A1, B1 and C1 of FIG. 12A. FIG. 12E is an enlarged cross-sectional view of the conductor 110A along a line I4-I4 of FIG. 12A. In FIGS. 12A to 12E, elements similar to those of the conductor 110 of the first embodiment have been assigned the same reference numerals, and their description is partially omitted.

As shown in FIGS. 12A to 12E, the conductor 110A includes an optical diffusion region 111A. The diffusion region 111A has multiple circular convex portions 115 as diffuser portions that diffuse light. Similarly to the concave portions 114, the convex portions are arranged on the conductor 110A in a zig-zag manner from one end of the conductor 110A to the other in the longitudinal direction. The first modification has advantages similar to those of the first embodiment.

Second Modification

Figure 13A:
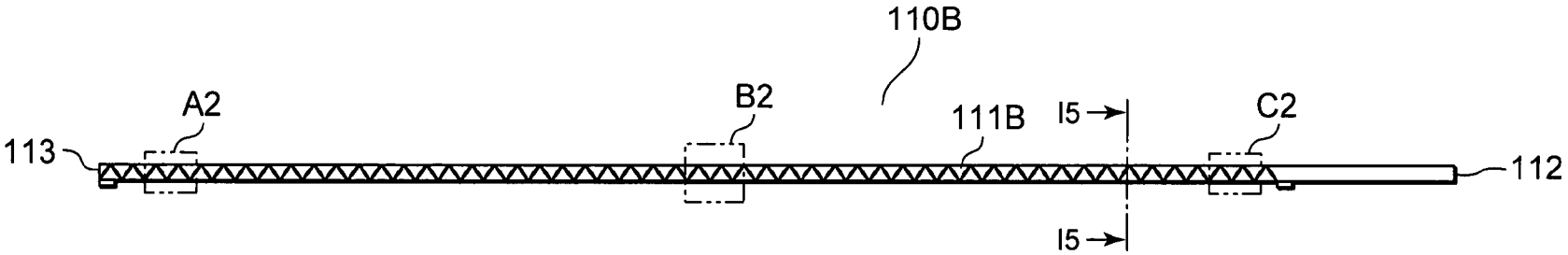
FIG. 13A is a side view of an optical conductor of a second modification.
Figure 13B:
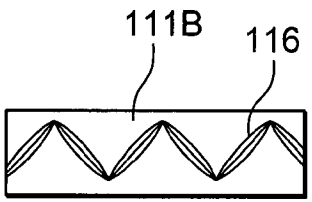
FIG. 13B is an enlarged side view of the optical conductor in an area A2 of FIG. 13A.
Figure 13C:
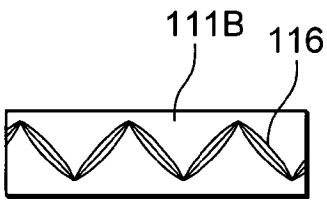
FIG. 13C is an enlarged side view of the optical conductor in an area B2 of FIG. 13A.
Figure 13D:
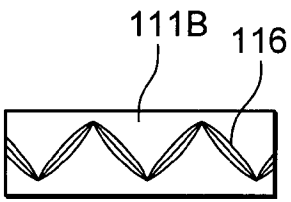
FIG. 13D is an enlarged side view of the optical conductor in an area C2 of FIG. 13A.
Figure 13E:
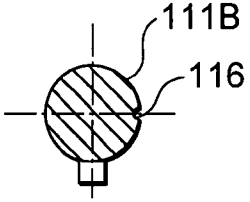
FIG. 13E is an enlarged cross-sectional view of the optical conductor along a line I5-I5 of FIG. 13A.

FIG. 13A is a side view of an optical conductor 110B of a second modification. FIGS. 13B, 13C and 13D are enlarged side views of the conductor 110B respectively in areas A2, B2 and C2 of FIG. 13A. FIG. 13E is an enlarged cross-sectional view of the conductor 110B along a line I5-I5 of FIG. 13A. In FIGS. 13A to 13E, elements similar to those of the conductor 110 of the first embodiment have been assigned the same reference numerals, and their description is partially omitted.

As shown in FIGS. 13A to 13E, the conductor 110B includes an optical diffusion region 111B. The diffusion region 111B has multiple grooves 116 as diffuser portions that diffuse light. The shape of each of the grooves 116 in cross-section is substantially triangular. In addition, each of the grooves 116 is arranged on the conductor 110B at a predetermined angle with respect to the longitudinal direction. That is to say, the grooves 116 are arranged on the conductor 110B in a zig-zag manner from one end of the conductor 110B to the other in the longitudinal direction. The second modification has advantages similar to those of the first embodiment.

Third Modification

Figure 14A:
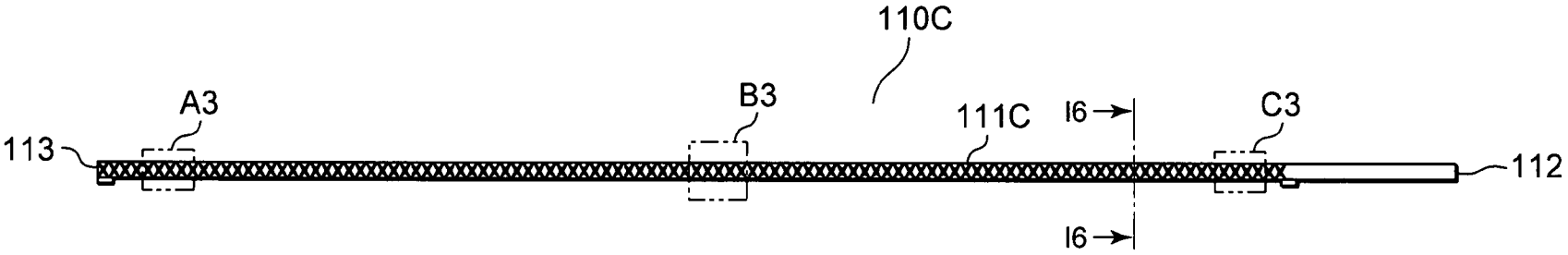
FIG. 14A is a side view of an optical conductor of a third modification.
Figure 14B:
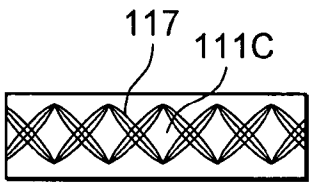
FIG. 14B is an enlarged side view of the optical conductor in an area A3 of FIG. 14A.
Figure 14C:
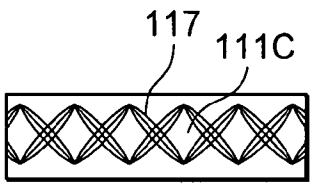
FIG. 14C is an enlarged side view of the optical conductor in an area B3 of FIG. 14A.
Figure 14D:
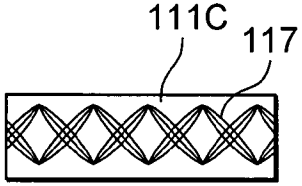
FIG. 14D is an enlarged side view of the optical conductor in an area C3 of FIG. 14A.
Figure 14E:
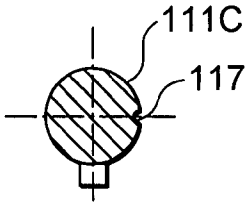
FIG. 14E is an enlarged cross-sectional view of the optical conductor along a line I6-I6 of FIG. 14A.

FIG. 14A is a side view of an optical conductor 110C of a third modification. FIGS. 14B, 14C and 14D are enlarged side views of the conductor 110C respectively in areas A3, B3 and C3 of FIG. 14A. FIG. 14E is an enlarged cross-sectional view of the conductor 110C along a line I6-I6 of FIG. 14A. In FIGS. 14A to 14E, elements similar to those of the conductor 110 of the first embodiment have been assigned the same reference numerals, and their description is partially omitted.

As shown in FIGS. 14A to 14E, the conductor 110C includes an optical diffusion region 111C. The diffusion region 111C has multiple grooves 117 as diffuser portions that diffuse light. The shape of each of the grooves 117 in cross-section is substantially triangular. In addition, each of the grooves 117 is arranged on the conductor 110C at a predetermined angle with respect to the longitudinal direction. That is to say, the grooves 117 are arranged on the conductor 110C in a zig-zag manner from one end of the conductor 110C to the other in the longitudinal direction. The third modification has advantages similar to those of the first embodiment.

Second Embodiment

A neutralization unit 200 of a second embodiment has the same structure as the neutralization unit 100 of the first embodiment, except for the structure of optical conductors.

Figure 16A:
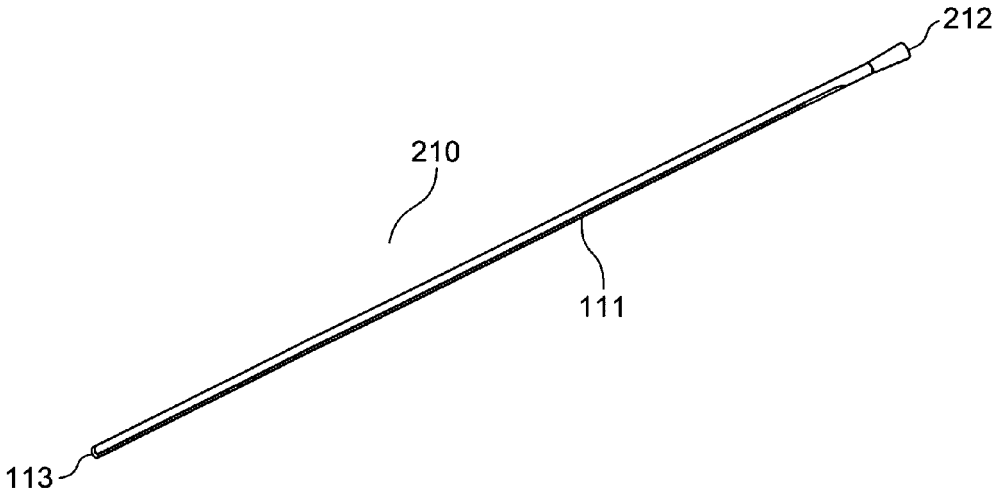
FIG. 16A is a first perspective view of the optical conductor of the second embodiment.
Figure 16B:
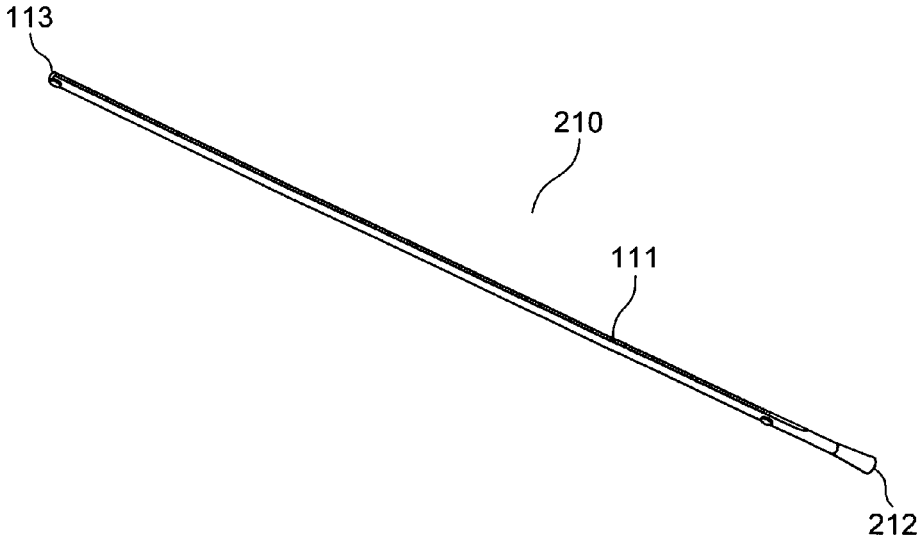
FIG. 16B is a second perspective view of the optical conductor of the second embodiment.

FIG. 15A is a side view of an optical conductor 210 of the second embodiment. FIGS. 15B, 15C and 15D are enlarged side views of the conductor 210 respectively in areas A4, B4 and C4 of FIG. 15A. FIG. 15E is an enlarged cross-sectional view of the conductor 210 along a line I7-I7 of FIG. 15A. FIGS. 16A and 16B are respectively first and second perspective views of the conductor 210. In FIGS. 15A to 15E, 16A and 16B, elements similar to those of the conductor 110 of the first embodiment have been assigned the same reference numerals and their description is partially omitted.

As shown in FIGS. 15A, 16A and 16B, the conductor 210 has a circular first end face 212 in place of the first end face 112, which receives light emitted by light source 130. The other structure of the conductor 210 is similar to that of the conductor 110 of the first embodiment.

Figure 17A:
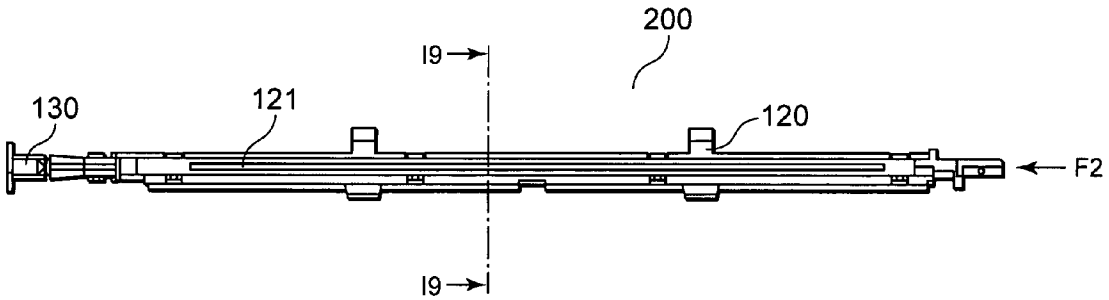
FIG. 17A is a side view of a neutralization unit of the second embodiment.
Figure 17B:
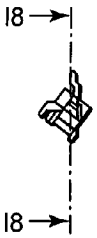
FIG. 17B is an end view of the neutralization unit from the direction of arrow F2 of FIG. 17A.
Figure 17C:
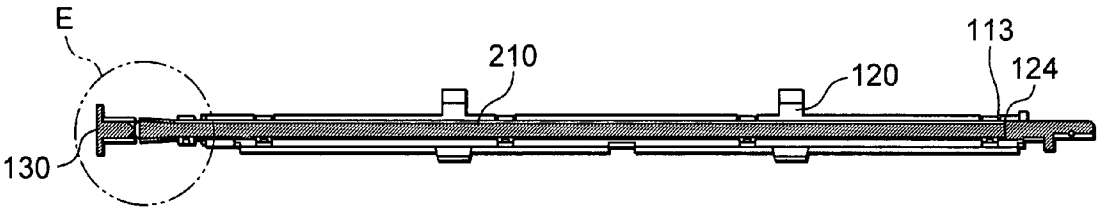
FIG. 17C is a cross-sectional view of the neutralization unit along a line I8-I8 of FIG. 17B.
Figure 17D:
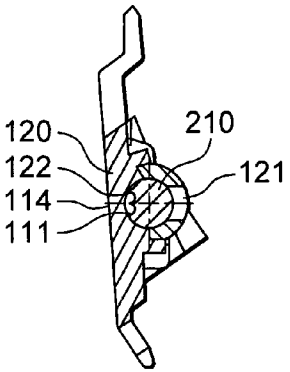
FIG. 17D is an enlarged cross-sectional view of the neutralization unit along a line I9-I9 of FIG. 17A.
Figure 18:
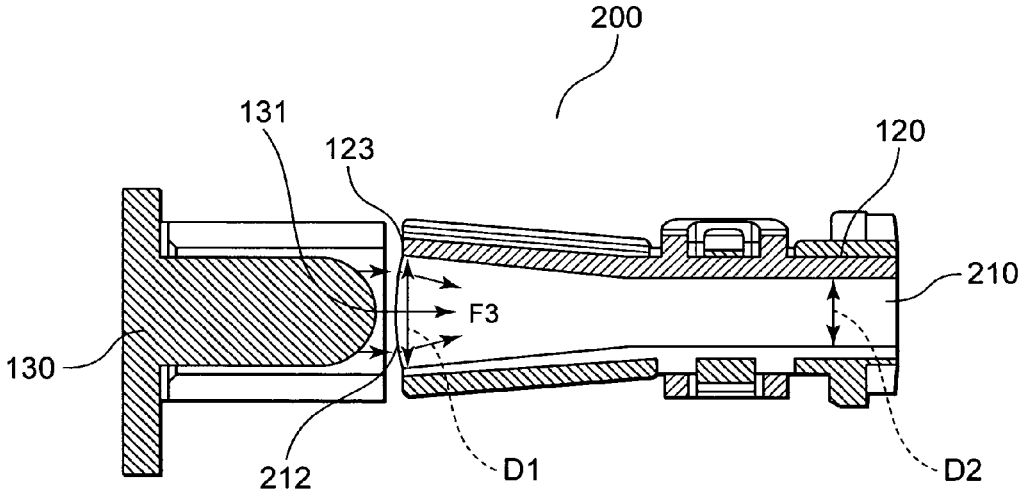
FIG. 18 is an enlarged cross-sectional view of the neutralization unit in an area E of FIG. 17C.

FIG. 17A is a side view of the neutralization unit 200. FIG. 17B is an end view of the neutralization unit 200 from the direction of arrow F2 of FIG. 17A. FIG. 17C is a cross-sectional view of the neutralization unit 200 along a line I8-I8 of FIG. 17B. FIG. 17D is an enlarged cross-sectional view of the neutralization unit 200 along a line I9-I9 of FIG. 17A. FIG. 18 is an enlarged cross-sectional view of the neutralization unit 200 in an area E of FIG. 17C.

As shown in FIG. 18, the diameter D1 of the end face 212 of the conductor 210 is larger than the diameter D2 of a portion of the conductor 210 at which the diffusion region 111 is formed, and the conductor 210 gradually broadens toward the light source 130. In addition, the end face 212 is larger than a light-emitting face 131 of the light source, which faces the end face 212. Moreover, the end face 212 has a convex shape that protrudes outwardly beyond the opening 123 of the cover 120. That is to say, the end face 212 has the configuration of a collective lens. Therefore, the conductor 210 can capture more light emitted by the light source, and efficiently direct the captured light to its interior by collecting the light in the direction of arrow F3. The conductor 210 also can capture light reflected within the printer 1.

As described above, in the second embodiment, the diameter D1 of the end face 212 of the conductor 210 is larger than the diameter D2 of the portion of the conductor 210 at which the diffusion region 111 is formed, and the end face 212 has the configuration of the collective lens. Therefore, the neutralization unit 200 can efficiently capture light emitted by the light source 130 and stably neutralize the surface of the photosensitive drum 21.

While each of the embodiments has been described with respect to an electrophotographic color printer, the invention may be applicable to a facsimile machine, a copier, or a multifunction peripheral (MFP).

The neutralization device, the developing device and the image forming apparatus being thus described, it will be apparent that the same may be varied in many ways. Such variations are not to be regarded as a departure from the spirit and scope of the invention, and all such modifications as would be apparent to one of ordinary skill in the art are intended to be included within the scope of the following claims.

What is claimed is:

1. A neutralization device comprising:

a light emitter configured to emit light that neutralizes an object;

a longitudinally extending optical conductor opposed to the object and configured to direct and apply the light to the object, the optical conductor being substantially columnar in a longitudinal direction; and a plurality of diffusion portions disposed on the optical conductor in a zig-zag manner from one end of the optical conductor to the other, and configured to diffuse the light;

wherein the optical conductor includes a first end face substantially perpendicular to the longitudinal direction and a second end face opposite to the first end face, the first end face being configured to face the light emitter so as to receive the light emitted by the light emitter; and wherein the first end face, the second end face, and a portion of the optical conductor at which the diffusion portions are formed respectively have first, second, and third diameters, the first diameter being larger than the second and third diameters.

2. The neutralization device according to claim 1, wherein the diffusion portions are provided on a side of the optical conductor that is opposite to a side facing the object.

3. The neutralization device according to claim 1, wherein each of the diffusion portions is substantially circular and concave.

4. The neutralization device according to claim 1, wherein each of the diffusion portions is substantially circular and convex.

5. The neutralization device according to claim 1, wherein each of the diffusion portions is a groove that is substantially triangular in cross section.

6. The neutralization device according to claim 1, wherein the diffusion portions are disposed on a plurality of parallel lines that extend in the longitudinal direction, and the number of lines in the vicinity of a central area of the optical conductor is larger than the number of lines in the vicinity of each of the first and second end faces of the optical conductor.

7. The neutralization device according to claim 1, wherein the first end face of the optical conductor is larger than a light-emitting face of the light emitter that faces the first end face.

8. The neutralization device according to claim 1, wherein the first end face has the configuration of a collective lens.

9. The neutralization device according to claim 1, wherein the optical conductor is made of a transparent material.

10. The neutralization device according to claim 9, wherein the transparent material is polymethylmethacrylate resin.

11. A neutralization device comprising:

a light emitter configured to emit light that neutralizes an object;

a longitudinally extending optical conductor opposed to the object and configured to direct and apply the light to the object, the optical conductor being substantially columnar in a longitudinal direction; and a plurality of diffusion portions disposed on the optical conductor on a plurality of parallel lines that extend in the longitudinal direction of the optical conductor, and configured to diffuse the light, the lines including a first line and a second line adjacent thereto, the diffusion portions including a plurality of first diffusion portions disposed on the first line and a plurality of second diffusion portions disposed on the second line, each first diffusion portion being adjacent to at least one of the second diffusion portions, each first diffusion portion having a center point that is separated in the longitudinal direction from a center point of each second diffusion portion that is adjacent thereto;

wherein the optical conductor includes a first end face substantially perpendicular to the longitudinal direction and a second end face opposite to the first end face, the first end face being configured to face the light emitter so as to receive the light emitted by the light emitter; and wherein the first end face, the second end face, and a portion of the optical conductor at which the diffusion portions are formed respectively have first, second, and third diameters, the first diameter being larger than the second and third diameters.

12. The neutralization device according to claim 11, wherein each first diffusion portion is adjacent to two successive second diffusion portions, and center points of said two successive second diffusion portions are on opposite sides, in the longitudinal direction, of the center point of said first diffusion portion.

13. The neutralization device according to claim 11, wherein the number of lines in the vicinity of a central area of the optical conductor is larger than the number of lines in the vicinity of each of the first and second end faces of the optical conductor.

14. A developing device comprising:

an image bearing body;

a charging member in contact with the image bearing body and configured to charge a surface of the image bearing body;

a light emitter configured to emit light that neutralizes the image bearing body;

a longitudinally extending optical conductor opposed to the image bearing body and configured to direct and apply the light to the image bearing body, the optical conductor being substantially columnar in a longitudinal direction; and a plurality of diffusion portions disposed on the optical conductor in a zig-zag manner from one end of the optical conductor to the other, and configured to diffuse the light;

wherein the optical conductor includes a first end face substantially perpendicular to the longitudinal direction and a second end face opposite to the first end face, the first end face being configured to face the light emitter so as to receive the light emitted by the light emitter; and wherein the first end face, the second end face, and a portion of the optical conductor at which the diffusion portions are formed respectively have first, second, and third diameters, the first diameter being larger than the second and third diameters.

15. The developing device according to claim 14, wherein a length of an exposure area of the optical conductor is smaller than a length of a charging area of the charging member, and is larger than a length of a printable area of the image bearing body, wherein length is measured in the longitudinal direction for each of the exposure area, the charging area and the printable area.

16. An image forming apparatus comprising:

the developing device according to claim 14 configured to form an image;

a transfer unit configured to transfer the image to a medium; and a fixing unit configured to fix the image onto the medium.

17. The image forming apparatus according to claim 16, wherein a length of an exposure area of the optical conductor is smaller than a length of a charging area of the charging member, and is larger than a length of a printable area of the image bearing body, wherein length is measured in the longitudinal direction for each of the exposure area, the charging area and the printable area.

* * * * *